US010302352B2

(12) United States Patent
Van Luven

(10) Patent No.: US 10,302,352 B2
(45) Date of Patent: May 28, 2019

(54) FLUID CONDITIONING APPARATUS

(71) Applicant: Adrian Van Luven, Tallahassee, FL (US)

(72) Inventor: Adrian Van Luven, Tallahassee, FL (US)

( * ) Notice: Subject to any disclaimer, the term of this patent is extended or adjusted under 35 U.S.C. 154(b) by 266 days.

(21) Appl. No.: 14/821,591

(22) Filed: Aug. 7, 2015

(65) Prior Publication Data

US 2017/0035251 A1 Feb. 9, 2017

(51) Int. Cl.
*F25D 25/00* (2006.01)
*F25D 31/00* (2006.01)
*F25D 3/08* (2006.01)

(52) U.S. Cl.
CPC ..... *F25D 25/005* (2013.01); *F25D 31/007* (2013.01); *F25D 3/08* (2013.01); *F25D 2303/081* (2013.01); *F25D 2331/803* (2013.01)

(58) Field of Classification Search
CPC ..... B01F 7/00208; B01F 7/00225; B01F 7/00216; A47J 43/0727; A47J 43/0716; A47J 43/0722; F25D 2400/28; F25D 31/002; F25D 31/003; F25D 31/006; F25D 31/007; F25D 31/008; F25D 17/02
See application file for complete search history.

(56) References Cited

U.S. PATENT DOCUMENTS 387,037 A 7/1888 Bennett
2,168,969 A * 8/1939 Bickerstaff ..... F25D 3/08 215/10
2,250,557 A * 7/1941 Tull ..... F25D 17/06 62/380
2,273,233 A * 2/1942 Tanner ..... F25D 17/06 312/128
D260,470 S 9/1981 Angelakos
D272,308 S 1/1984 Schlessel
4,843,836 A 7/1989 Childers
5,184,544 A 2/1993 Ling
5,235,823 A 8/1993 Coker
5,671,664 A * 9/1997 Jacobson ..... A23B 7/0205 134/102.3
6,135,019 A * 10/2000 Chou ..... A23N 1/00 366/205
D455,051 S 4/2002 Gjersvik
6,676,051 B2 * 1/2004 Rebordosa ..... A47J 43/06 241/282.1
6,684,756 B2 2/2004 Kerr
7,370,492 B2 5/2008 Hoare et al.

OTHER PUBLICATIONS

Sunbeam Products, Inc.—Oster Quick Chilling Wine Chiller User Guide, 2010.

* cited by examiner

*Primary Examiner* — Tho V Duong
(74) *Attorney, Agent, or Firm* — AU LLC; Adam E. Urbanczyk

(57) ABSTRACT

An apparatus for fluid conditioning of an object and materials located therein. The apparatus comprises a vessel, a perforated carriage insert, and a lid. The vessel further includes a liquid in fluidic communication with the perforated carriage insert. A circulating means is mounted within the vessel and is driven by an external power source.

9 Claims, 6 Drawing Sheets

FLUID CONDITIONING APPARATUS

BACKGROUND OF THE INVENTION

Field of the Invention

The present invention relates to appliances, typically residing within or around a kitchen or bar, which are used to rapidly condition, heat, or cool a beverage or food container and its contents; for example, a wine bottle, soda can, frozen drink mix cylinder, or infuser.

Description of Relevant Prior Art

The practice of heating or cooling food and beverage containers to bring their contents to a desired temperature is well known. Container-specific devices have been proposed in an effort to increase the efficiency with which the container, and its contents, may be heated or cooled.

One such device is depicted in U.S. Pat. No. 7,370,492 entitled "Chiller." Depicted there is a wine bottle cooling device that utilizes an insulated reservoir, a "cooling ring" insert, and an impellor that directs a fluid between the reservoir's walls and the "cooling ring" and around the wine bottle. The device relies on the "cooling ring" insert, and its series of "freezer bricks" to chill the fluid that is directed within the reservoir and around the cooling ring to, ultimately, cool the wine bottle.

Another device is depicted in U.S. Pat. No. 7,174,723 entitled "Portable Liquid Cooler." Depicted there is a container cooling device that utilizes a sandwich of rotating solid heat sinks to draw heat energy away from the container as the heat sinks are rotated about the container's outside surface.

The practice of directly heating or cooling a liquid stored within an open container is also well known. One such device accomplishing this task is depicted in U.S. Pat. No. 5,235,823 entitled "Cooling Device." Depicted there is essentially an immersible heat sink in the form of a sealed volume of "freezeable" material. The device is first frozen and, when ready to be utilized, is simply immersed into a container of liquid desired to be cooled (e.g., water in a pitcher). The device's shape is designed to maximize heat transfer from the liquid to the device with its distil, immersed end have a larger surface area than the proximal tapering end.

Another device is depicted in U.S. Pat. No. 4,843,836 entitled "Beverage Chiller and Method Therefore." Depicted there is another immersed heat sink-type cooling device that, instead of being a sealed volume of freezeable material, is a cylinder open at one end that can at once be (i) immersed into a container in which liquid desired to be cooled resides and (ii) filled with ice such that the cylinder becomes the heat sink and draws heat from the liquid and into the ice. The device also incorporates a handle and clip by which the device can be handled and secured to the vessel containing the liquid volume.

The practice of infusing a liquid with tea, coffee, or other particulate is also well known. One such device accomplishing this task is depicted in U.S. Pat. No. D272308 entitled "Tea Infuser." Depicted there is a cylindrical chamber with perforated floor. A "flip-top" lid is also provided. The user presumably would place loose tea within the cylindrical chamber and close the lid. The cylindrical chamber could then be immersed into a liquid, the liquid rising up into the cylindrical chamber through the perforations in the chamber's bottom, exposing the loose tea containing within the chamber to the fluid. This device and type of infusion it necessitates is not only passive, but the oils and other flavor compounds lighter than water and within the tea leached therefrom by the fluid would be trapped within the chamber and, once the device is removed from the liquid, would remain on the loose tea particulate as the water recedes out from the perforations.

Another device is depicted in U.S. Pat. No. 6,684,756 entitled "Tea Infuser with Manual Agitator." Depicted there is a device not unlike a cocktail shaker. The device, into which loose tea is place, has walls with a series of perforations. Additionally, the device integrates a plunger-type stirring implement attached to the device's top that, when the top is placed onto the device, acts within the device's interior by is actuated from outside of the device via a spindle. When used, the device is filled with loose tea, the top placed onto the device, the device is immersed in a fluid, and the user manually agitates the loose tea via the device's plunger implement. While this type of infusion is more active than, say, that occurring with the use of the aforementioned "Tea Infuser," the amount of agitation is limited with that which the user can manually provide and the physical travel of the plunger within the device.

The litany of prior art devices designed to condition a container, or liquid therein, are only partially successful inasmuch as they are limited to only heating or cooling particular types of containers, require laborious operation (e.g., repeated refilling of loose ice cubes), or inefficiently use passive thermal management. Similarly, existing infusing devices restrict the fluid mechanics necessary for efficient infusion of tea or particulate matter into a surrounding fluid or require undesirable manual actuation.

BRIEF SUMMARY OF THE INVENTION

The present invention first comprises a vessel. The vessel contains a fluid and a means by which the fluid is circulated within the vessel. A carriage is inserted into the vessel and immersed within the fluid contained therein. The carriage allows the fluid contained in the vessel to also circulate through the carriage. A container desired to be conditioned is placed within the carriage and a lid is placed onto the vessel's top or on the carriage itself. The vessel's circulating means is activated and the fluid circulates within the vessel, through the carriage, and around or through the container within the carriage rapidly exchanging thermal energy or fluid communication.

BRIEF DESCRIPTION OF THE DRAWINGS

The accompanying figures and drawings, incorporated into and forming part of the specification, service to further illustrate the present invention, its various principles and advantages, and its varying embodiments.

DETAILED DESCRIPTION OF THE INVENTION

Figure 1:
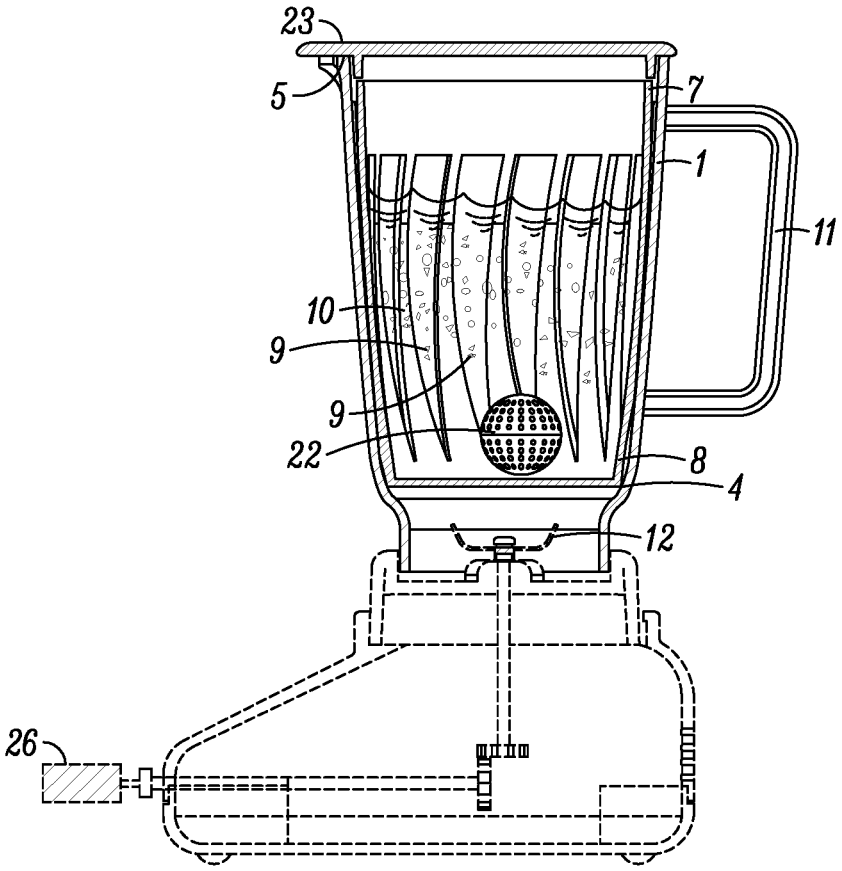
FIG. 1 depicts a vertical cross sectional view of an assembled fluid conditioning apparatus showing an infuser ready for conditioning.

Provided is a fluid conditioning apparatus that operates to rapidly cool or heat a container, or beverage therein, or infuse a liquid through rapid fluidic communication. FIG. 1 shows a vertical cross sectional view of an assembled fluid conditioning apparatus. A vessel 1 and handle 11 rest atop a circulating means. A carriage 7 is inserted into the vessel. Upon full insertion into the vessel 1, the bottom portion of the carriage 8 abuts the lower portion of the vessel wall 4. This keeps the carriage 7 from falling into the circulating means, in this case a rotating blade 12. Water 10 at a desired temperature fills the vessel and the carriage. An infuser 22 is placed into the carriage 6 and a flat vessel lid 23 is placed onto the vessel rim 5. The crankshaft 26 is turned and actuates the rotating blade 12, in turn driving the water 10 within the vessel. As it is driven within the vessel 1, the water flows through the perforations 9 in the carriage and around and through the infuser 22, rapidly and continuously exposing the contents of the infuser (e.g., loose tea leaves, coffee grounds) to the water and thus infusing it. The flat vessel lid 23 prevents the driven water 10 from splashing out of the vessel 1. After a time sufficient to infuser the water, the crankshaft 26 may be deactivated, the flat vessel lid 23 removed, and the carriage 7 extracted from the vessel 1, leaving the vessel empty save the infused water.

Figure 6:
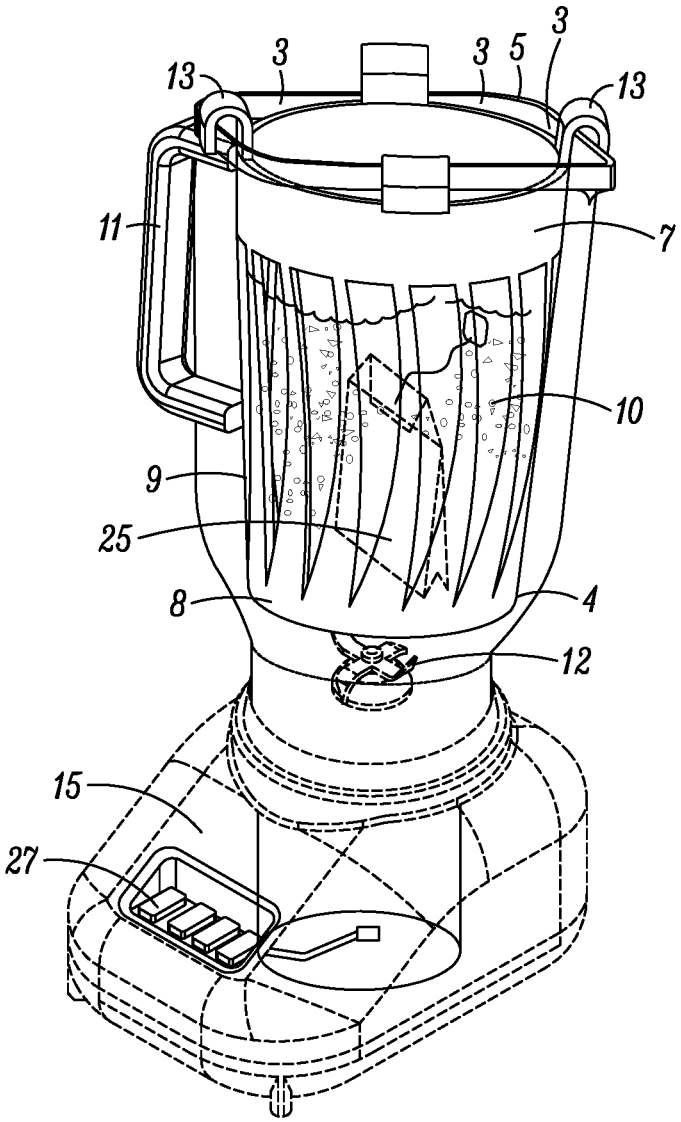
FIG. 6 depicts an assembled perspective view of a fluid conditioning apparatus showing a vessel into which a tea bag is being conditioned while in a carriage that is supported by four arms.

FIG. 6 illustrates an alternate infusing configuration. Depicted there is an assembled perspective view of the claimed invention showing a vessel with multiple vessel walls 3 without a lid mounted on the vessel rim 5. A carriage 7 is inserted into the vessel. Multiple carriage arms 13 extend from the carriage and secure against the vessel rim 5 holding the carriage above the rotating blade 12. The vessel is filled with water 10 that can flow within the vessel and through the carriage perforations 9. A tea bag 25 is placed into the carriage. The motor 15 is activated and actuates the rotating blade, driving the water within the vessel and carriage at a desired speed. For example, if the user wishes to infuse the water over a longer period of time, the user may select a reduced motor speed resulting in slower water movement within the vessel and reduced risk of driven water splashing out of the vessel, obviating a vessel lid. Once the water has been infused for a desired amount of time or to a desired extent based on the user's visual inspection of the water within the vessel, the motor 15 may be deactivated via motor controls 27, carriage 7 and tea bag 25 removed, and vessel 1 used to dispense the infused liquid.

Figure 2:
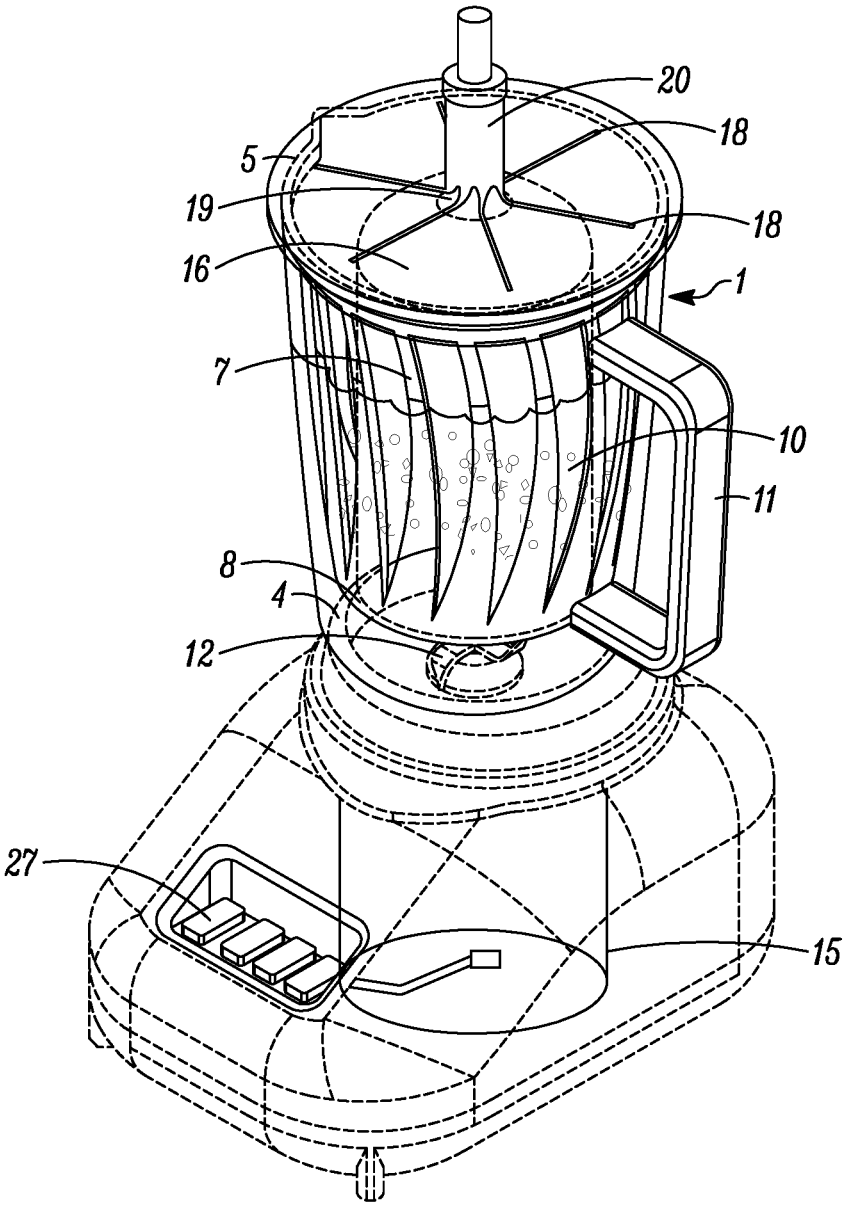
FIG. 2 depicts an assembled perspective view of the fluid conditioning apparatus showing the vessel into which a wine bottle and its contents are being conditioned within the carriage.
Figure 4:
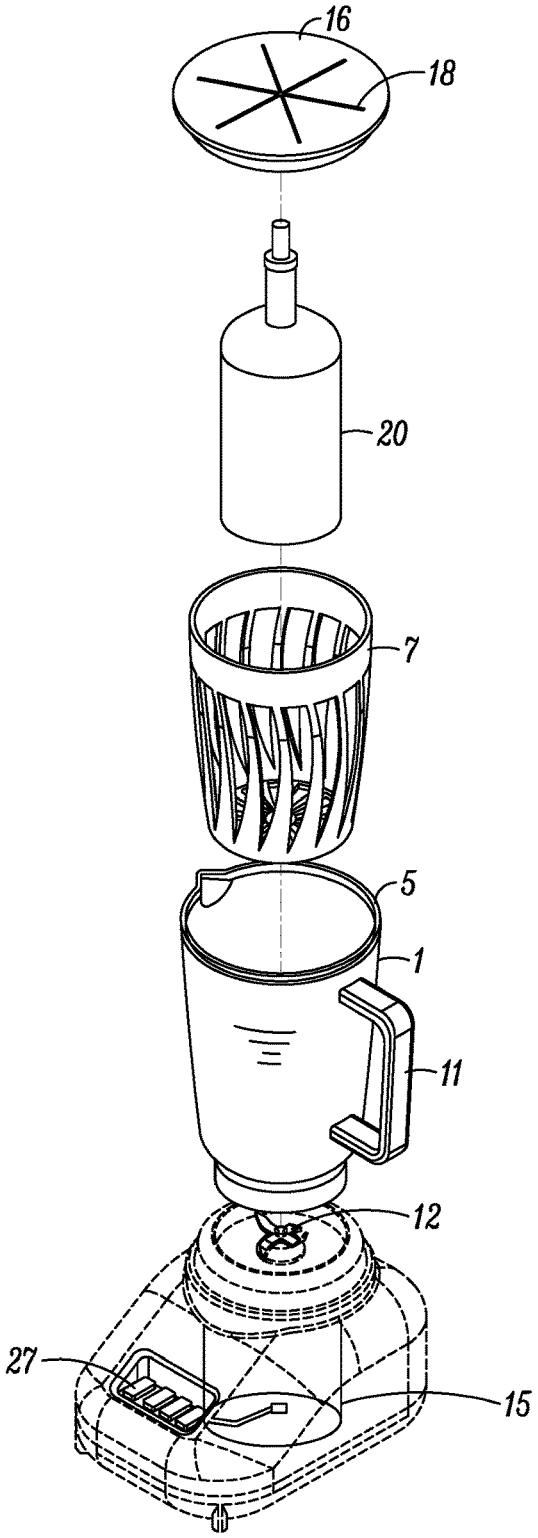
FIG. 4 depicts an exploded perspective view of the fluid conditioning apparatus.

By isolating the source of fluid movement from the object receiving the thermal or communicative fluid interaction, the claimed invention can also condition a beverage as illustrated in FIG. 2. Depicted there is a vessel 1 with a handle 11 that rests atop a motor 15 as in FIG. 6. A carriage 7 is placed into the vessel and the bottom portion of the carriage 8 abuts the lower portion of the vessel wall 4 to prevent the carriage from falling into the rotating blade 12. A wine bottle 20 rests within the carriage and water 10 at a desired temperature is filled into the vessel and carriage. A lid rests atop the vessel rim 5. The lid has a flexible surface 16 across which multiple slits 18 are drawn creating leaves 19. Because the neck of the bottle 20 extends above the vessel rim 5, the leaves 19 flex to closely drape the neck of the bottle. FIG. 4 depicts an exploded assembly view of the configuration depicted in FIG. 2. When in use, the motor 15 is activated via control 27 thereby actuating the rotating blade 12 which itself drives the water within the vessel and carriage. The seal created by the flexible leaves conforming to the neck of the bottle 20 prevent water from splashing outside of the vessel. Once the bottle and its contents are heated or cooled by the circulating water to a desired temperature, the motor can be deactivated, lid removed, and bottle extracted from the carriage.

Figure 3:
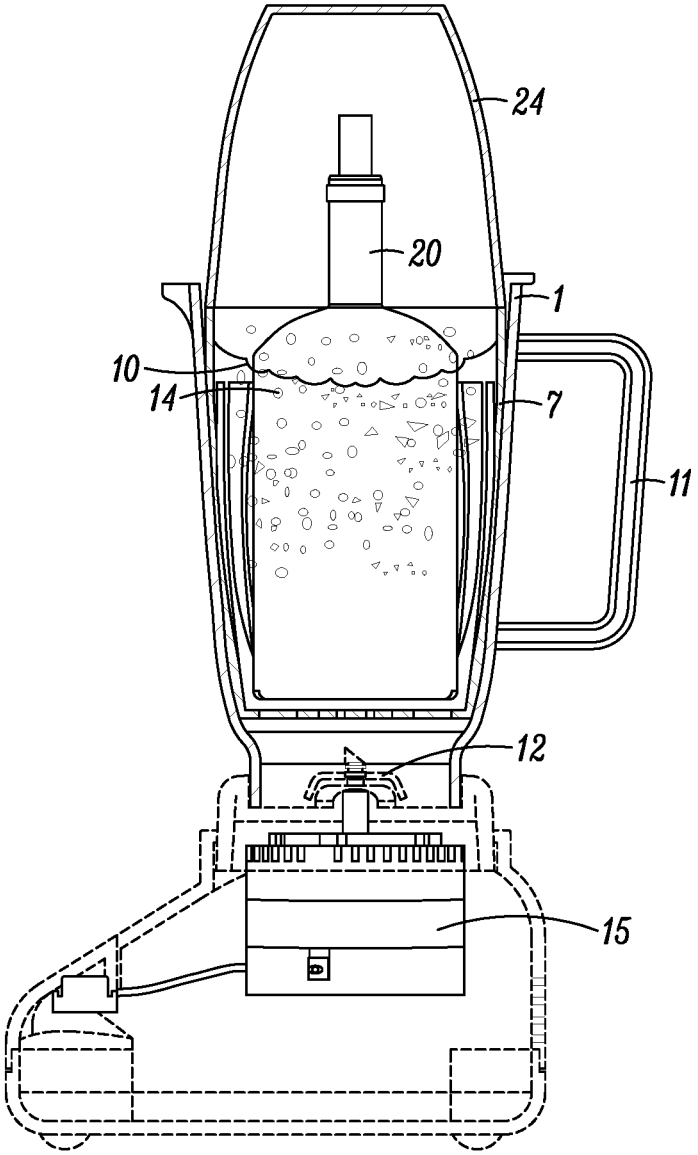
FIG. 3 depicts an assembled vertical cross sectional view of the fluid conditioning apparatus showing the vessel into which a bottle and its contents are being conditioned within the carriage.
Figure 5:
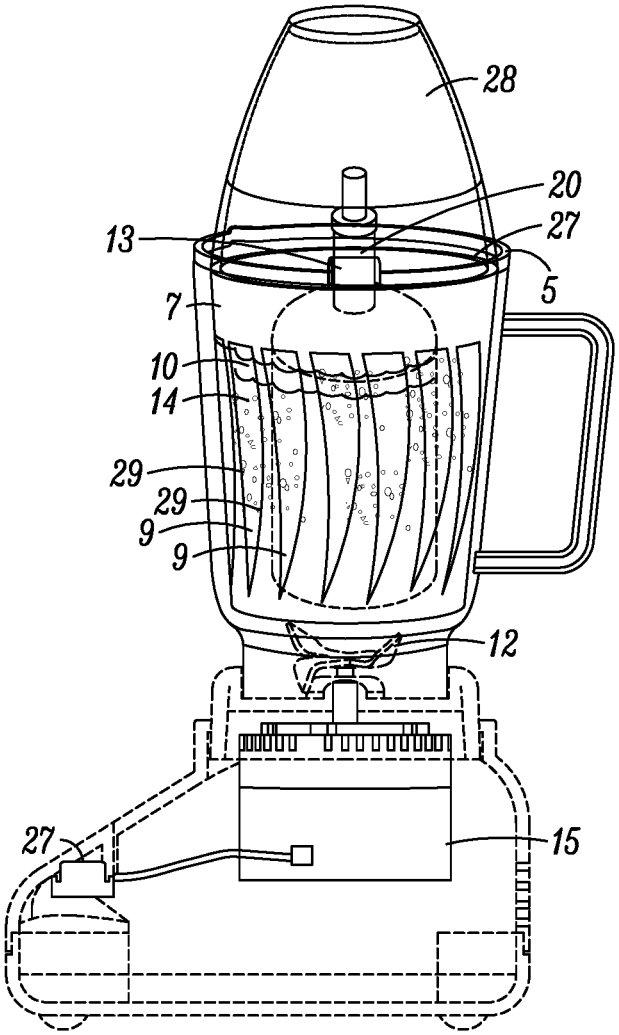
FIG. 5 depicts an assembled perspective view of a fluid conditioning apparatus showing the vessel into which a bottle and its contents are being conditioned while in a carriage that is supported by one arm.

The fluid conditioning or the bottle illustrated in FIG. 2 may be compared with the fluid conditioning of a bottle illustrated in FIG. 5. Depicted there is a vertical cross sectional view of the claimed invention showing a vessel 1 with a lid 28 mounted on the carriage 7. A carriage 7 is inserted into the vessel. A single carriage arm 13 extends from the carriage and secures against the vessel rim 5 holding the carriage above the rotating blade 12. The vessel is filled with ice 14 and water 10, the water being able to flow within the vessel and through the carriage perforations 9. Salt 29 is also added to the vessel to decrease the freezing point of the water within the vessel and improve thermofluid performance. When in use, the motor 15 actuates the rotating blade 12 to drive the fluid water within the vessel and through the carriage. The carriage acts to keep the ice and can-like container away from the rotating blade vet allows the water and ice mixture to rapidly cool the can-like container and its contents. Where the user would not provider excessive actuating power to the rotating blade via the motor 15 and its controls 27, a lid would be unnecessary as the water and ice mixture would not attain sufficiently angular velocity to spill over the vessel rim 5.

Where more rapid fluid conditioning is desired, or when the container to by fluidly conditioned is large enough such that it would extend above the vessel rim, a vessel lid, as depicted in FIG. 3, with a domed portion 24 may be used. The shape of the vessel may allow for alternative means of maintaining separation between the carriage and the circulating means. For example, where the vessel walls are largely vertically parallel to each other, the carriage's bottom portion may have one or more legs which extend from the carriage's bottom portion and stand on or against the vessel's inner surface, such as its floor provided each leg's footprint is located sufficiently away from the path of the circulating means.

As exemplified in FIG. 1, the claimed invention can infuse a liquid with a desired substance, the infusing action generally involving exposing the liquid to particulate substances without the particulate escaping into the liquid. Just as the claimed invention could be used to create tea, it may also be used to infuse cooking oil with herbs or infuse spirits with fruit, other flavor-sources, or simply ice.

Although the above detailed descriptions relate to specific preferred embodiments as the inventor presently contemplates, it will be understood that the invention in its broad aspects includes mechanical and functional equivalents of the elements described herein. Various details of design and construction may be modified without departing from the true spirit and scope of the invention which is set forth in the following claims.

I claim:

1. An apparatus for fluid conditioning comprising:

a vessel having a floor and at least one vertically extending vessel wall terminating in a vessel rim;

a set of rotating blades shaped to impart swirl motion to liquid contained in the vessel, the set of rotating blades disposed at the floor of the;

a carriage having a base, a wall extending from the base, and an open top defining volume of the carriage, the carriage sized to be removably mounted within the vessel and over the set of rotating blades such that the base faces the set of rotating blades without any contact of the base with the set of rotating blades, wherein the base of the carriage and an inner bottom portion of the vessel are shaped such that the base of the carriage abuts the inner bottom portion of the vessel; and a plurality of perforations disposed in each of the base and the wall of the carriage, the plurality of perforations shaped to permit liquid to pass through, wherein the perforations in the wall are an elongated curve shape.

2. The apparatus for fluid conditioning according to claim 1, wherein the vessel further comprises a handle.

3. An apparatus for fluid conditioning according to claim 1, wherein the carriage comprises at least one arm, the at least one arm positioning the carriage bottom portion away from the circulating means by securing against the vessel rim.

4. The apparatus for fluid conditioning according to claim 1, wherein the apparatus further comprises liquid.

5. The apparatus for fluid conditioning according to claim 4, wherein the liquid is water, the apparatus further comprises ice.

6. The apparatus for fluid conditioning according to claim 5, wherein the apparatus further comprises salt.

7. An apparatus for fluid conditioning according to claim 1, further comprising a vessel lid, the vessel lid sized for mounting on the vessel rim.

8. An apparatus for fluid conditioning according to claim 7, wherein the vessel lid comprises a membrane extending across the vessel lid surface, the membrane provided with at least one slit defining at least two leaves, the at least two leaves bending to receive a portion of the container that protrudes above the vessel rim as the container rests within the carriage.

9. The apparatus for fluid conditioning according to claim 1, further comprising a vessel lid, the vessel lid shaped to removably mount over the open top of the vessel.

* * * * *